US007571748B2

(12) United States Patent
Shao

(10) Patent No.: US 7,571,748 B2
(45) Date of Patent: Aug. 11, 2009

(54) VACUUM CONTAINER

(75) Inventor: Hung Chiang Shao, Panchiao (TW)

(73) Assignee: Mini-Dolphin Industrial Co., Ltd., Taipei County (TW)

( * ) Notice: Subject to any disclaimer, the term of this patent is extended or adjusted under 35 U.S.C. 154(b) by 449 days.

(21) Appl. No.: 11/355,984

(22) Filed: Feb. 17, 2006

(65) Prior Publication Data

US 2007/0193915 A1 Aug. 23, 2007

(51) Int. Cl.
*B65B 31/00* (2006.01)
*B65D 81/20* (2006.01)

(52) U.S. Cl. ..... 141/66; 141/7; 141/8; 141/65; 206/524.8; 53/432; 53/510

(58) Field of Classification Search ..... 141/7, 141/65, 66, 8; 206/459.1, 524.8; 53/432, 53/510
See application file for complete search history.

(56) References Cited

U.S. PATENT DOCUMENTS

| | | | | | |
|---|---|---|---|---|---|
| 4,243,349 | A * | 1/1981 | Hickey et al. | ..... | 206/524.8 |
| 4,901,634 | A * | 2/1990 | Kuwahara et al. | ..... | 206/524.8 |
| 5,232,016 | A * | 8/1993 | Chun | ..... | 220/367.1 |
| 5,398,811 | A * | 3/1995 | Latella, Jr. | ..... | 206/524.8 |
| 5,725,091 | A * | 3/1998 | Knoebel | ..... | 206/362.1 |
| 5,806,575 | A * | 9/1998 | Tsay | ..... | 141/65 |
| 5,964,255 | A * | 10/1999 | Schmidt | ..... | 141/65 |
| 6,019,034 | A * | 2/2000 | Ford, Sr. | ..... | 141/65 |
| 6,968,870 | B1 * | 11/2005 | Tsay | ..... | 141/65 |
| 6,994,227 | B2 * | 2/2006 | Kwon | ..... | 141/65 |
| 7,040,356 | B2 * | 5/2006 | Tarlow | ..... | 141/65 |
| 7,246,555 | B2 * | 7/2007 | Small et al. | ..... | 141/65 |
| 7,247,330 | B2 * | 7/2007 | Kuethe et al. | ..... | 426/325 |
| 2002/0083724 | A1 * | 7/2002 | Tarlow et al. | ..... | 62/131 |
| 2004/0031245 | A1 * | 2/2004 | Kingeter et al. | ..... | 53/510 |
| 2004/0099332 | A1 * | 5/2004 | Kieck | ..... | 141/65 |
| 2005/0183396 | A1 * | 8/2005 | Higer et al. | ..... | 53/510 |
| 2005/0236293 | A1 * | 10/2005 | Turvey et al. | ..... | 206/459.1 |
| 2006/0008400 | A1 * | 1/2006 | Gutman | ..... | 422/292 |
| 2007/0095713 | A1 * | 5/2007 | Schooley | ..... | 206/524.8 |

FOREIGN PATENT DOCUMENTS

WO WO 01/55662 A1 * 8/2001

* cited by examiner

*Primary Examiner*—Timothy L Maust
*Assistant Examiner*—Nicolas A Arnett
(74) *Attorney, Agent, or Firm*—Birch, Stewart, Kolasch & Birch, LLP

(57) ABSTRACT

A vacuum container comprises a body coupled with a bottom seat having an air sucking device mounted therein, the body having a micro switch electrically connected to the air sucking device, a fastener having a second lever slidably contacted with a lever of the micro switch, a first lever having a first end with a pin optionally coupled to a hole defined in the body and a second end slidably contacted with the second lever of the fastener, and a spring mounted between the second end of the first lever and a tab of the body; and a cover pivotally connected to the body and having tabs for being clamped with the fastener of the body. When the cover is closed, the air sucking device can automatically start operation to suck air from the container for keeping food fresh therein.

14 Claims, 8 Drawing Sheets

VACUUM CONTAINER

BACKGROUND OF THE INVENTION

1. Field of the Invention

The present invention relates generally to a vacuum container, and in particular to a vacuum container having an air sucking device automatically sucking air from the container to keep vacuum for maintaining food fresh therein.

2. The Prior Arts

A conventional airtight container includes a body and a cover detachably connected to the body to prevent outside air from entering into the container so as to preserve the food stored therein. However, after a period of time, outside air eventually enters into the container that will cause decomposition of the food stored therein. In order to solve the shortcoming, an improved airtight container has been introduced on the market. This type of airtight container is equipped with a manually vacuum pump and a check valve. With the provision of the vacuum pump, the air inside the container can be sucked out so as to keep vacuum for maintaining the food fresh therein.

However, because there is not provided with any vacuum detection device to monitor the vacuum status inside the container, users cannot know whether air leaks or not. Additionally, the vacuum pump needs to be manually operated. Accordingly, the vacuum status cannot keep uniform every time using the airtight container.

A further shortcoming of the conventional airtight container is that there is no indication as to when the food is stored therein. In order to record storage time of food, the users generally paste the airtight container with a sticker with a date marked thereon, so that the users are able to judge whether the food is still edible. However, that will destroy the appearance of the container.

Thus, it is desired to provide a vacuum container, which can solve the aforementioned problems.

SUMMARY OF THE INVENTION

A primary objective of the present invention is to provide a vacuum container having an air sucking device that can automatically suck air from the container to keep vacuum for maintaining the food fresh therein.

Another objective of the present invention is to provide a vacuum container having a date recording device such that users can know when the food is stored therein.

A further objective of the present invention is to provide a vacuum container having an ozone generator that can further enhance food fresh-keeping effect.

To achieve the above-mentioned objectives, in accordance with a first aspect of the present invention, a vacuum container is provided, comprising a body coupled with a bottom seat having an air sucking device mounted therein, the body having a micro switch electrically connected to the air sucking device, a fastener having a second lever slidably contacted with a lever of the micro switch, a first lever having a first end with a pin optionally coupled to a hole defined in the body and a second end slidably contacted with the second lever of the fastener, and a spring mounted between the second end of the first lever and a tab of the body; and a cover pivotally connected to the body and having tabs for being clamped with the fastener of the body. When the cover is closed, the air sucking device can automatically start operation to suck air from the container until a preset vacuum status is reached. When it is reached, the air sucking device automatically stops operation.

In accordance with a second aspect of the present invention, the vacuum container further comprises a date recording device mounted on the cover.

In accordance with a third aspect of the present invention, the vacuum container further comprises an ozone generator connected to an inlet of the container via a hose and electrically connected to the vacuum pump. When the container reaches a preset vacuum status, the vacuum pump stops operation and then the ozone generator starts operation for a period of preset time.

The present invention will become more obvious from the following description when taken in connection with the accompanying drawings, which show, for purposes of illustration only, preferred embodiments in accordance with the present invention. In the drawings:

DETAILED DESCRIPTION OF THE PREFERRED EMBODIMENT

Figure 1:
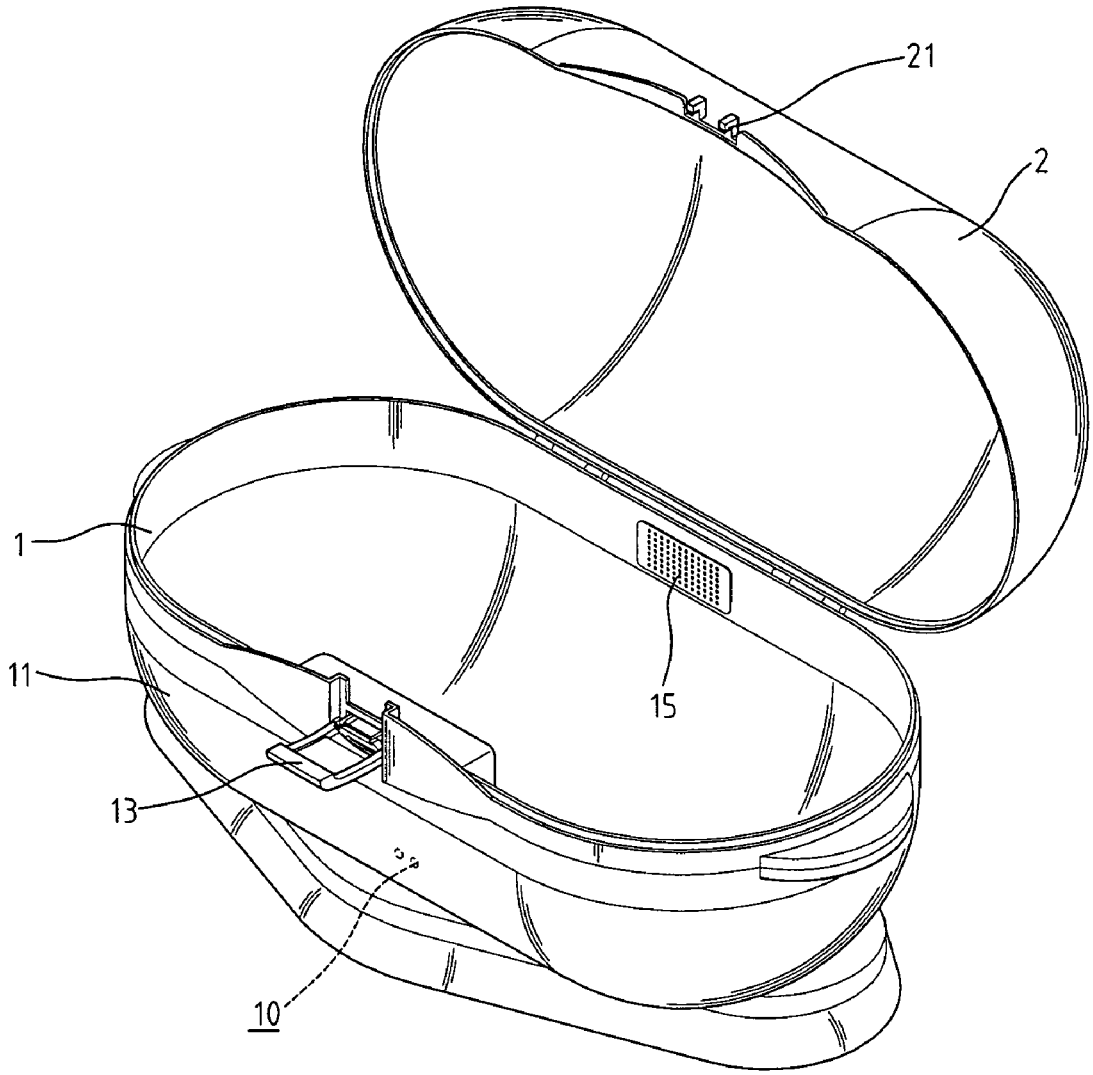
FIG. 1 is a perspective view of a vacuum container in accordance with the present invention, comprising a body and a cover pivotally connected to the body wherein the cover is in open state.
Figure 2:
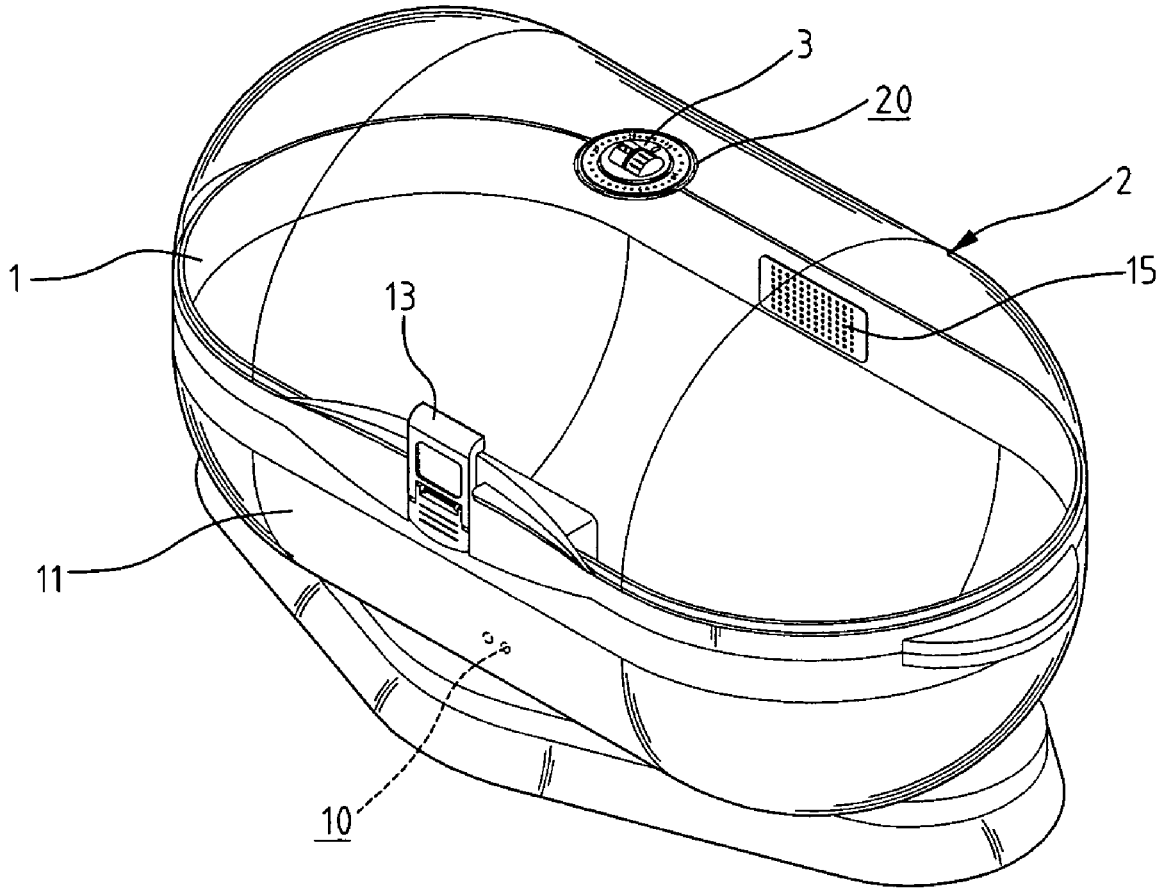
FIG. 2 is a perspective view of the vacuum container of the present invention, wherein the cover is in tightly close state.
Figure 3:
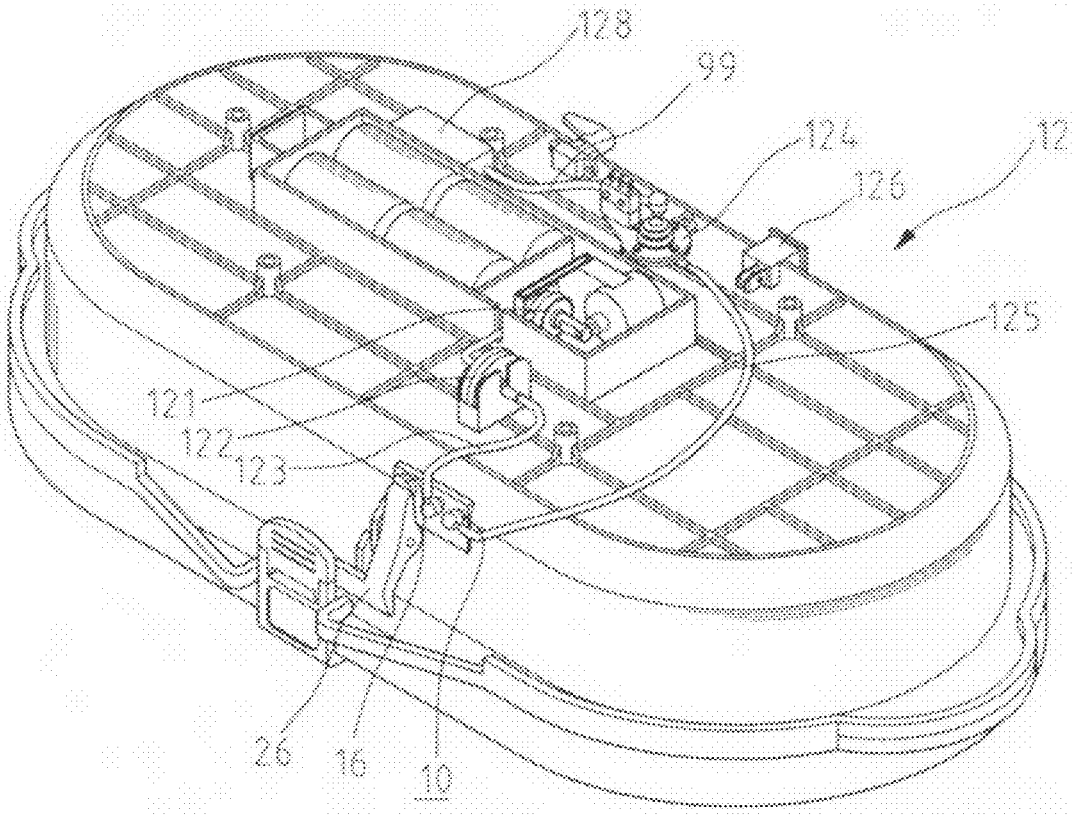
FIG. 3 is a schematic assembled view of an air sucking device in accordance with the present invention.

With reference to the drawings and in particular to FIGS. 1-3, a vacuum container constructed in accordance with the present invention includes a body 1, a cover 2 pivotally connected to the body 1, and a date recording device 3 mounted on the cover 2.

The body 1 is coupled with a bottom seat 11 having an air sucking device 12 mounted therein (see FIG. 3). The body 1 has a fastener 13 locked on tabs 21 of the cover 2 when the cover 2 is closed. Further, the body 1 has a micro switch 25 having a lever 251 slidably contacted with a second lever 131 of the fastener 13 and electrically connected to the air sucking device 12 (see FIGS. 7*a* and 7*b*), and a first lever 26 having a first end with a pin 261 optionally coupled to a hole 16 defined in the body 1 and a second end slidably contacted with the second lever 131 of the fastener 13 (see FIGS. 8*a* and 8*b*). A spring 27 is mounted between a second end of the first lever 26 and a tab 17 of the body 1.

Referring to FIG. 3, the air sucking device 12 in accordance with the present invention includes a vacuum pump 121, a check valve 122 connected to the vacuum pump 121, a first air hose 123 connecting between the check valve 122 and outlets 10 of the body 1, a vacuum-controlling device 124 connected with the outlets 10 via a second air hose 125, and a power switch 126 optionally provided for connection between a power supply and the vacuum pump 121 and the vacuum-controlling device 124. It is noted that the power supply may be a battery set.

Figure 4A:
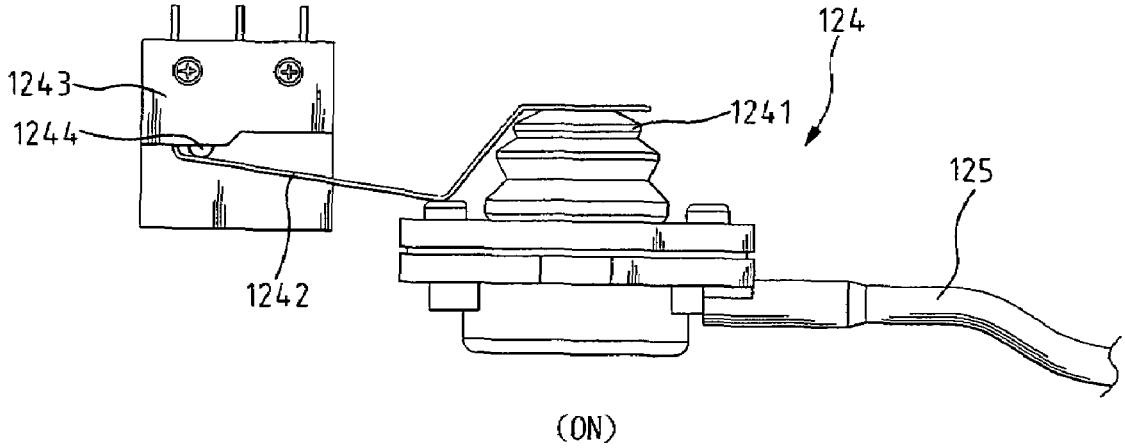
FIG. 4*a* is a side view of a vacuum-controlling device in accordance with the present invention, showing a state that a contact switch can start a vacuum pump to operate.
Figure 4B:
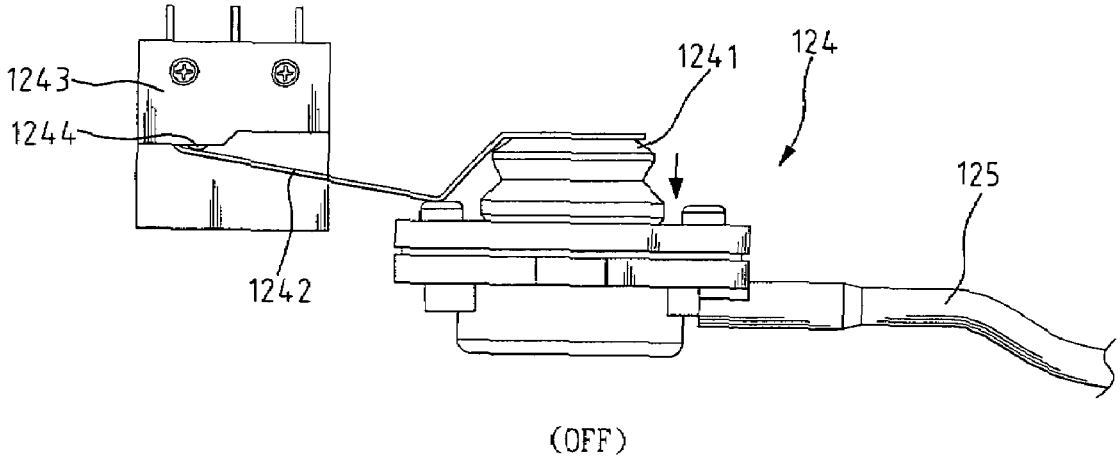
FIG. 4*b* is a side view of the vacuum-controlling device of the present invention, showing another state that the contact switch stops the vacuum pump.

Referring to FIGS. 4*a* and 4*b*, the vacuum-controlling device 124 includes a bellows 1241 connected with the second air hose 125, a contact switch 1243 electrically connected to the vacuum pump 121 and having a trigger 1244 movably and electrically connected thereto, and a linkage 1242 mounted between the contact switch 1243 and the bellows 1241. That means a first end of the linkage 1242 is contacted with the trigger 1244 of the contact switch 1243 and a second end of the linkage 1242 is mounted to a top end of the bellows 1241. When the vacuum pump 121 starts operation, it sucks air from the bellows 1241 and the body 1 through the outlets 10. At the air sucking process, the height of the bellows 1241 will be gradually descending and the first end of the linkage 1242 will be gradually ascending so as to push down the trigger 1244 of the contact switch 1243. When the body 1 and the bellows 1241 reaches a preset vacuum status, the height of the bellows 1241 descends to a preset height; thereby, the first end of the linkage 1242 pushes down the trigger 1244 of the contact switch 1243 to stop the vacuum pump 121.

After a period of time using the vacuum container to store food, outside air will gradually enter into the container and the bellows 1241, so as to inflate the bellows 1241; thereby the height of the bellows 1241 will be gradually ascending and the first end of the linkage 1242 will be gradually descending. When the first end of the linkage 1242 descends to allow the trigger 1244 to bounce out of the contact switch 1243, the vacuum pump 121 restarts to operate. The vacuum operation is operated in repeated following the above steps.

Figure 5:
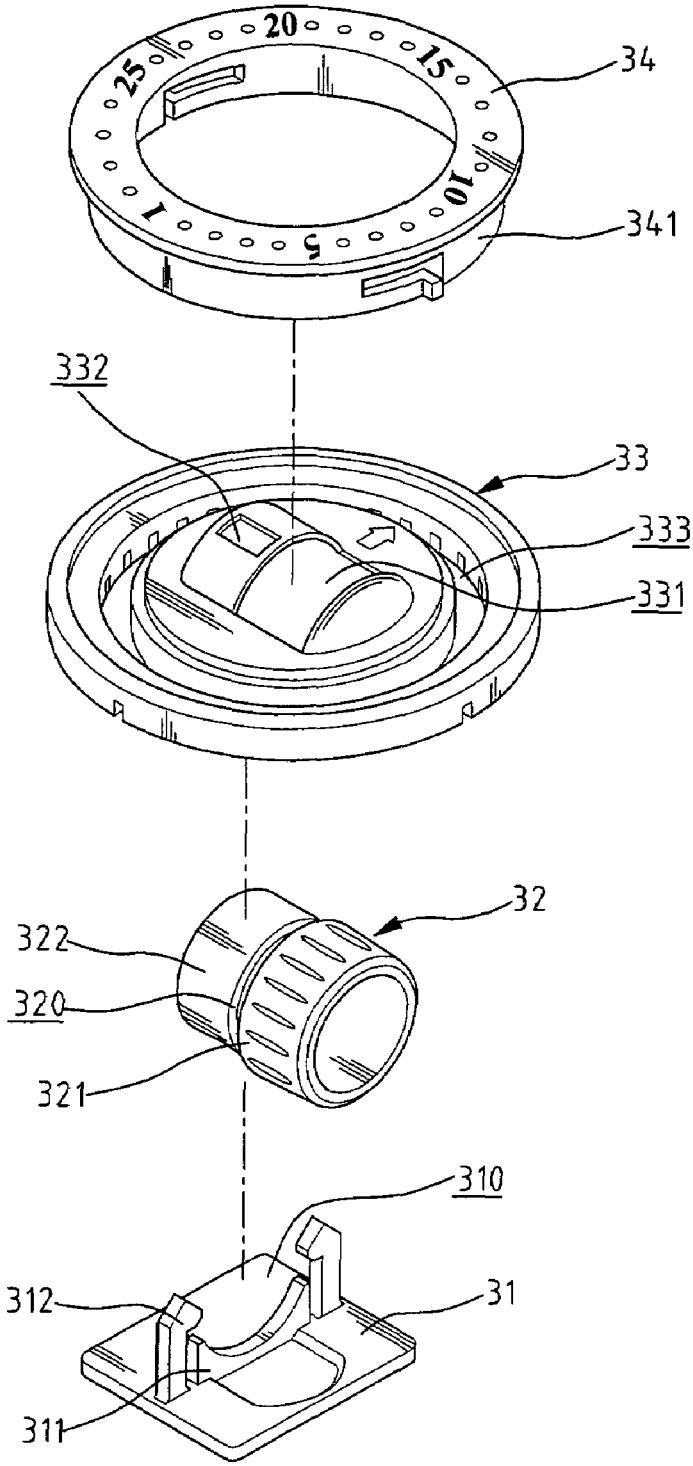
FIG. 5 is an exploded view of a date recording device in accordance with the present invention.

Referring to FIG. 5, the date recording device 3 in accordance with the present invention includes a seat 31, a rotor 32, a disk 33 and a ring 34. The seat 31 has a base plate (not labeled), a concave member 311 seated on the base plate, and two limiting posts 312 respectively mounted on opposite sides of the concave member 311 to form a receiving space 310. The rotor 32, which is received in the concave member 310, has a dial ring 321, a sleeve 322 on which month numbers are uniformly marked, and a ring groove 320 defined at a joint between the dial ring 321 and the sleeve 322 to rotatably engage with the concave member 311. The disk 33 has an annular recess 333, an arcuate opening 331 defined in a top face of the disk 33 to receive the dial ring 321, a window 332 defined adjacent to the arcuate opening 331 for displaying the month numbers on the sleeve 322. The ring 34 has a central through hole (not labeled) and a flange 341 extending downward from a bottom face of the ring 34 for rotatably received in the annular recess 333.

Figure 6:
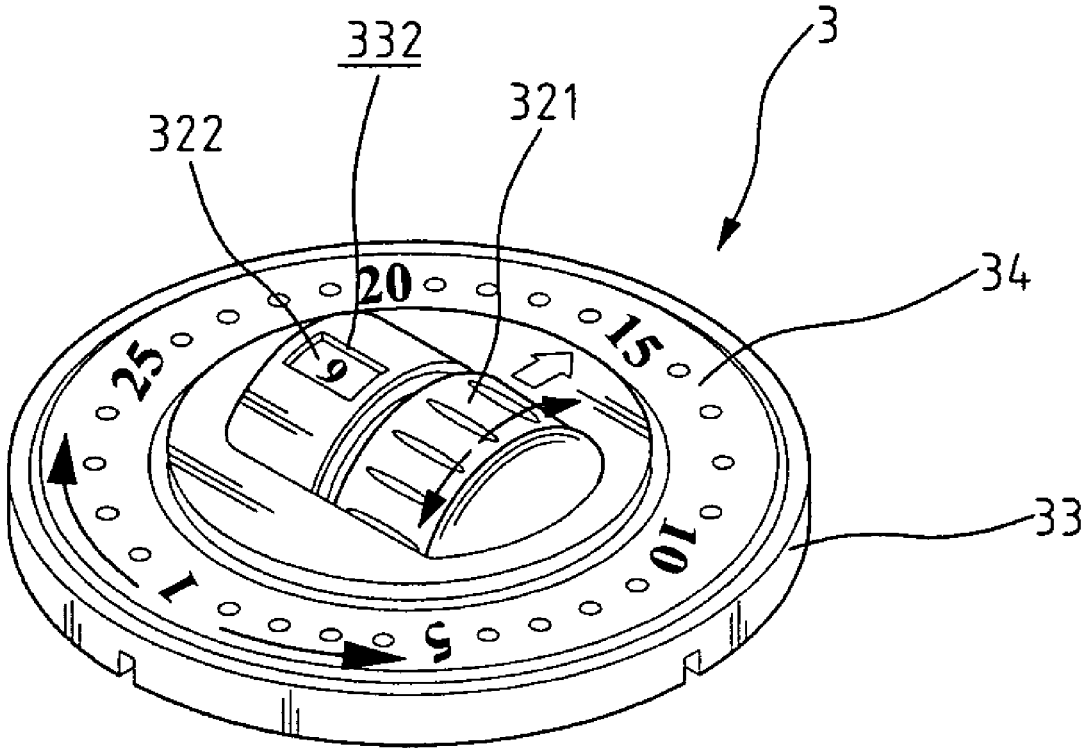
FIG. 6 is an assembled view of FIG. 5.

Referring to FIG. 6, which shows an assembled date recording device 3 in accordance with the present invention, users can rotate the dial ring 321 of the rotor 32 to a correct month of storing food, for example 9, which shows on the window 332, and rotate the ring 34 to a correct day of storing food, for example 15, which aligns with an arrow on the top face of the disk 33, thereby being capable of exactly knowing the food-storing date.

Figure 7A:
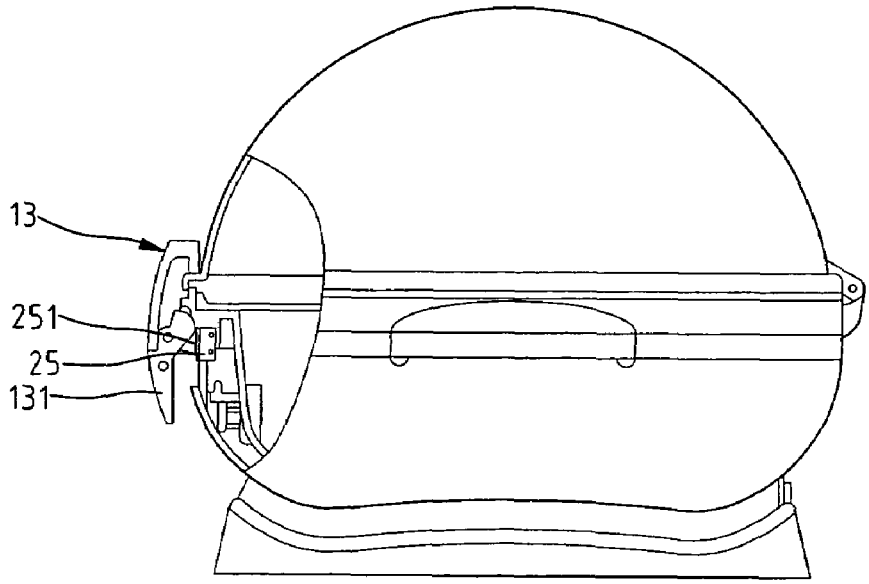
FIG. 7*a* is a partially sectional view showing that when the cover of the container is closed, a second lever of a fastener pushes down a lever of a micro switch to start the vacuum pump.
Figure 7B:
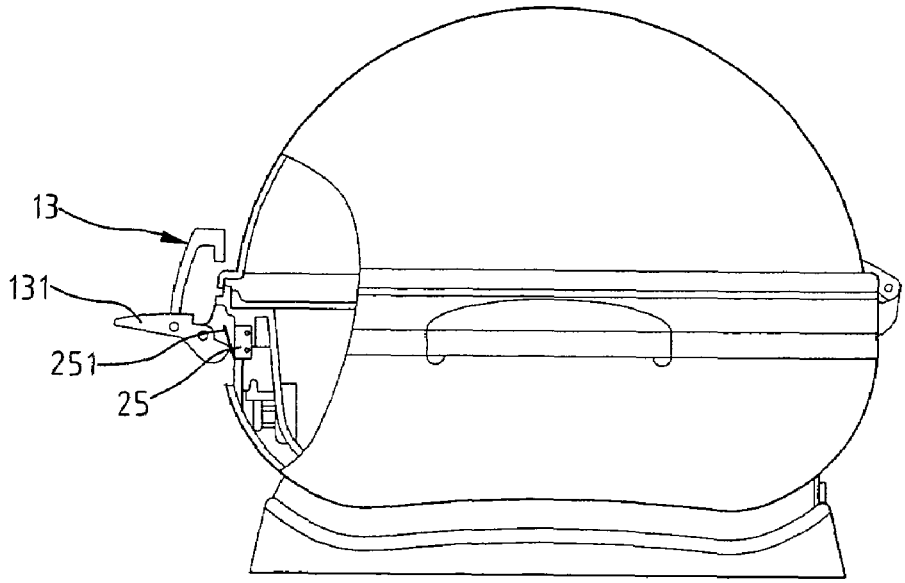
FIG. 7*b* is a partially sectional view showing that when the cover of the container is to be opened, the second lever of the fastener releases the lever of the micro switch to stop the vacuum pump.

Referring to FIGS. 7*a* and 7*b*, in practical operation, first, turn on the power switch 126, then put food into the container, close the cover 2, and lock the fastener 13 on the tabs 21 of the cover 2. When the fastener 13 is securely locked on the tabs 21 of the cover 2, the second lever 131 of the fastener 13 pushes down the lever 251 of the micro switch 25 to start the air sucking device 12. Once the vacuum container reaches a preset vacuum status, the air sucking device 12 will automatically stop operation by the control of the vacuum-controlling device 124. After a period of time, outside air will gradually enter into the container and the bellows 1241 of the vacuum-controlling device 124, so as to inflate the bellows 1241. When the bellows 1241 inflates to a preset height, the first end of the linkage 1242 releases the trigger 1244 of the contact switch 1243 to restart the air sucking device 12. The air sucking device 12 is repeatedly and alternatively operated according to the above procedure.

Figure 8A:
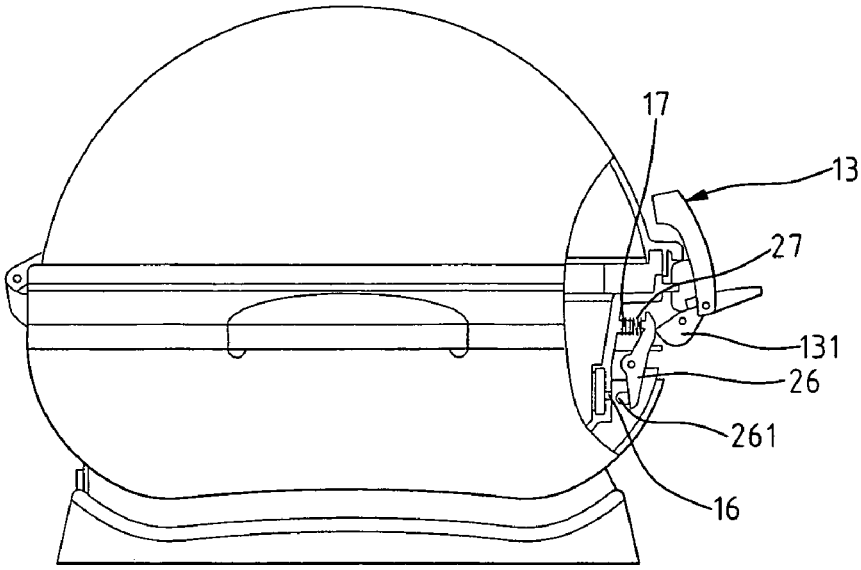
FIG. 8*a* is a partially sectional view showing that when the cover of the container is to be opened, a pin of a first lever moves away from a hole defined in the body to let outside air enter into the container for breaking vacuum therein for easily opening the cover.
Figure 8B:
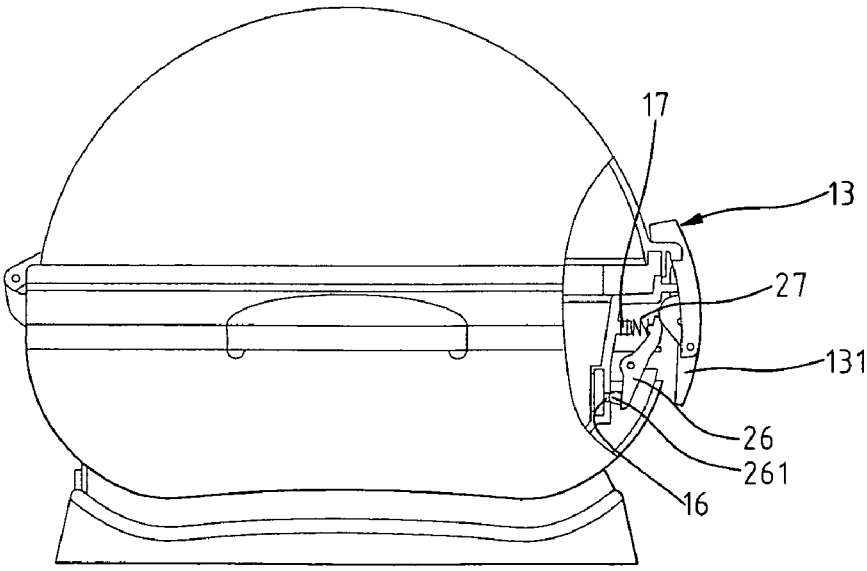
FIG. 8*b* is a partially sectional view showing that when the cover of the container is closed, the pin of the first lever is inserted into the hole defined in the body to stop outside air entering into the container.

Referring to FIGS. 8*a* and 8*b*, when the food stored in the container wants to be taken out, at the time of unlocking the fastener 13 from the tabs 21 of the cover 2, the second lever 131 of the fastener 13 pushes down the second end of the first lever 26 and the pin 261 of the first lever 26 moves away from the hole 16 defined in the body 1. Therefore, outside air can enter into the container to break vacuum therein for easily opening the cover 2.

Additionally, referring to FIGS. 1-3, in order to enhance food fresh-keeping effect, the vacuum container of the present invention further comprises an ozone generator 128 connected to an inlet 15 via an ozone carrying hose 99. The ozone generator 128 is electrically connected to the vacuum pump 121. When the container reaches a preset vacuum status, the vacuum pump 121 stops operation and then the ozone generator 128 starts operation for a period of preset time.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A vacuum container, comprising:

a body coupled with a bottom seat having an air sucking device mounted therein, the body having a micro switch electrically connected to the air sucking device, a fastener having a second rotatable lever slidably contacted with a lever of the micro switch, a first rotatable lever having a first end with a pin coupled to a hole defined in the body for releasing vacuum pressure from the container during opening of a cover and a second end slidably contacted with the second rotatable lever of the fastener, and a spring mounted between the second end of the first rotatable lever and a tab of the body; and a cover pivotally connected to the body and having tabs for being clamped with the fastener of the body, wherein the first lever is mounted on the air sucking device and the second lever is mounted on the body.

2. The vacuum container as claimed in claim 1, further comprising a date recording device mounted on the cover.

3. The vacuum container as claimed in claim 2, wherein the date recording device includes a seat, a rotor, a disk, and a ring, wherein the seat has a base plate, a concave member seated on the base plate, and two limiting posts respectively mounted on opposite sides of the concave member to form a receiving space; the rotor, which is received in the concave member, has a dial ring, a sleeve on which month numbers are uniformly marked, and a ring groove defined at a joint between the dial ring and the sleeve to rotatably engage with the concave member; the disk has an annular recess, an arcuate opening defined in a top face of the disk to receive the dial ring, a window defined adjacent to the arcuate opening for displaying the month numbers on the sleeve; and the ring has a central through hole and a flange extending downwards from a bottom face of the ring for rotatably received in the annular recess.

4. The vacuum container as claimed in claim 1, wherein the air sucking device comprises a vacuum pump, a check valve connected to the vacuum pump, a first air hose connecting between the check valve and outlets of the body, a vacuum-controlling device connected with the outlets via a second air hose, and a power switch provided for connection between a power supply and the vacuum pump and the vacuum-controlling device.

5. The vacuum container as claimed in claim 4, wherein the vacuum-controlling device comprises a bellows connected with the second air hose, a contact switch electrically connected to the vacuum pump and having a trigger movably and electrically connected thereto, and a linkage mounted between the trigger of the contact switch and a top end of the bellows.

6. The vacuum container as claimed in claim 1, further comprising an ozone generator connected to an inlet of the container via, the ozone carrying hose being electrically connected to the vacuum pump.

7. The vacuum container as claimed in claim 1, wherein the second lever is rotatably mounted on the body.

8. A vacuum container, comprising:

a body coupled with a bottom seat having an air sucking device mounted therein, the body having a micro switch electrically connected to the air sucking device, a fastener having a second lever slidably contacted with a lever of the micro switch, a first lever having a first end with a pin coupled to a hole defined in the body for releasing vacuum pressure from the container during opening of a cover and a second end slidably contacted with the second lever of the fastener, and a spring mounted between the second end of the first lever and a tab of the body; and a cover pivotally connected to the body and having tabs for being clamped with the fastener of the body, wherein the first lever is mounted on the air sucking device, and the second lever is mounted on the body.

9. The vacuum container as claimed in claim 8, further comprising a date recording device mounted on the cover.

10. The vacuum container as claimed in claim 8, wherein the date recording device includes a seat, a rotor, a disk, and a ring, wherein the seat has a base plate, a concave member seated on the base plate, and two limiting posts respectively mounted on opposite sides of the concave member to form a receiving space; the rotor, which is received in the concave member, has a dial ring, a sleeve on which month numbers are uniformly marked, and a ring groove defined at a joint between the dial ring and the sleeve to rotatably engage with the concave member; the disk has an annular recess, an arcuate opening defined in a top face of the disk to receive the dial ring, a window defined adjacent to the arcuate opening for displaying the month numbers on the sleeve; and the ring has a central through hole and a flange extending downwards from a bottom face of the ring for rotatably received in the annular recess.

11. The vacuum container as claimed in claim 8, wherein the air sucking device comprises a vacuum pump, a check valve connected to the vacuum pump, a first air hose connecting between the check valve and outlets of the body, a vacuum-controlling device connected with the outlets via a second air hose, and a power switch provided for connection between a power supply and the vacuum pump and the vacuum-controlling device.

12. The vacuum container as claimed in claim 11, wherein the vacuum-controlling device comprises a bellows connected with the second air hose, a contact switch electrically connected to the vacuum pump and having a trigger movably and electrically connected thereto, and a linkage mounted between the trigger of the contact switch and a top end of the bellows.

13. The vacuum container as claimed in claim 8, further comprising an ozone generator connected to an inlet of the container via an ozone carrying hose, the ozone generator being electrically connected to the vacuum pump.

14. The vacuum container as claimed in claim 8, wherein the second lever is rotatably mounted on the body.

* * * * *